US012453422B2

(12) United States Patent
Lake

(10) Patent No.: US 12,453,422 B2
(45) Date of Patent: Oct. 28, 2025

(54) TWO-MOTOR LIFT AND RECLINE SYSTEM FOR POWERED CHAIRS

(71) Applicant: HIDDENLAKE 822, LLC, Tupelo, MS (US)

(72) Inventor: Stephen R. Lake, Tupelo, MS (US)

(73) Assignee: HIDDENLAKE 822, Tupelo, MS (US)

( * ) Notice: Subject to any disclaimer, the term of this patent is extended or adjusted under 35 U.S.C. 154(b) by 103 days.

(21) Appl. No.: 18/131,981

(22) Filed: Apr. 7, 2023

(65) Prior Publication Data

US 2024/0335039 A1 Oct. 10, 2024

(51) Int. Cl.

| | |
|---|---|
| ***A47C 1/035*** | (2006.01) |
| ***A47C 1/032*** | (2006.01) |
| ***A47C 1/0355*** | (2013.01) |
| ***A61G 5/14*** | (2006.01) |

(52) U.S. Cl.

CPC ..... *A47C 1/03211* (2013.01); *A47C 1/0355* (2013.01)

(58) Field of Classification Search

CPC ..... A47C 1/0355; A47C 1/0345; A47C 1/035; A47C 7/5068; A47C 1/024

See application file for complete search history.

(56) References Cited

U.S. PATENT DOCUMENTS

| | | | | |
|---|---|---|---|---|
| 5,312,153 | A * | 5/1994 | Lin | A47C 1/0345 297/DIG. 10 |
| 5,651,580 | A * | 7/1997 | LaPointe | A61G 5/14 297/DIG. 10 |
| 6,974,186 | B1 * | 12/2005 | Chang | A47C 1/035 297/69 |
| 8,123,289 | B2 | 2/2012 | Qiu et al. | |
| 8,403,409 | B2 | 3/2013 | Pollard et al. | |
| 9,931,256 | B2 * | 4/2018 | White | A61G 5/14 |
| 11,166,562 | B2 * | 11/2021 | Zhang | A61G 5/14 |
| 11,540,632 | B2 * | 1/2023 | Zhang | A61G 5/14 |
| 11,969,095 | B2 * | 4/2024 | Liu | A47C 1/035 |
| 2012/0299363 | A1 * | 11/2012 | Crum | A47C 1/0352 297/85 M |
| 2015/0054315 | A1 * | 2/2015 | Donovan | A47C 1/0345 297/325 |
| 2015/0054316 | A1 * | 2/2015 | Donovan | A47C 1/0342 297/313 |
| 2015/0282619 | A1 * | 10/2015 | Lawson | A47C 1/0355 297/83 |

* cited by examiner

*Primary Examiner* — Shin H Kim

(74) *Attorney, Agent, or Firm* — LAW OFFICES OF STEVEN W. WEINRIEB

(57) ABSTRACT

A two-motor lift and recline system for a powered chair comprises a base, at least one footrest/ottoman support bracket for mounting and supporting a footrest or ottoman thereon, at least one seat rail for mounting and supporting a seat thereon, at least one backrest support bracket for mounting and supporting a backrest thereon, a first linear actuator mounted upon the base and operatively connected to the at least one footrest/ottoman support bracket for moving the at least one footrest/ottoman support bracket between extended and retracted positions, and a second linear actuator mounted upon the at least one seat rail and operatively connected to the at least one backrest support bracket for moving the at least one backrest support bracket between fully upright and fully reclined positions.

19 Claims, 11 Drawing Sheets

TWO-MOTOR LIFT AND RECLINE SYSTEM FOR POWERED CHAIRS

FIELD OF THE INVENTION

Figure 1:
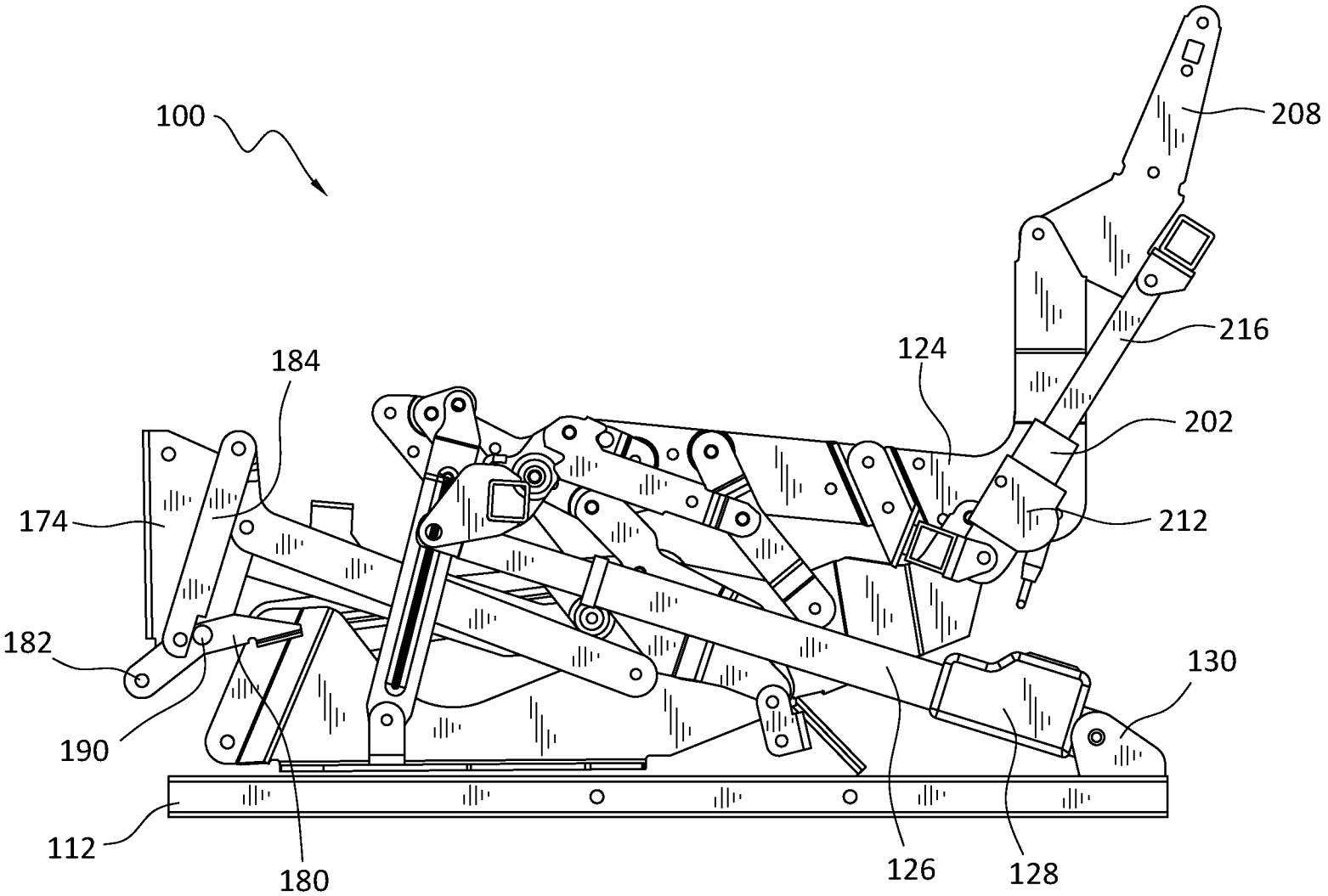

The present invention relates generally to powered chairs, and more particularly to a new and improved powered chair which utilizes two linear actuators for moving the various components of the chair between various desired positions. More specifically, the new and improved chair has been structured so as to provide the chair with enhanced side-to-side stability, as well as enhanced forward and rearward stability, such that the chair is not susceptible to tipping, particularly when the occupant of the chair is in the process of exiting the chair so as to stand or walk. Still yet further, the primary or first linear actuator, for moving the seat and footrest sections of the chair, will be disposed at its fully retracted position so as to raise the front of the seat section, as opposed to the conventional lowering of the rear portion of the seat section, while the footrest/ottoman section of the chair is moved to its extended position. This elevated disposition of the front seat section of the chair, as a result of the front of the seat section being raised, also permits the side arms of the chair to extend down to the floor or support surface, upon which the chair is disposed, because the aforenoted conventional lowering of the rear portion of the seat section of the chair need no longer needs to be accommodated. Lastly, the second linear actuator is utilized to move the back section of the chair to a reclined position, and is adapted to be operated independently of the movements of the seat and footrest or ottoman sections of the chair as controlled by the first or primary linear actuator.

BACKGROUND OF THE INVENTION

Reclining lounger chairs are of course well known and are utilized in many residences and business establishments. In residences, for example, homeowner or rental occupants use such chairs in family rooms, living rooms, dens, home offices, and bedrooms. In business establishments, such chairs may be utilized within individual offices, conference rooms, and the like. In either case, such chairs are extremely popular and desirable, however, they do sometimes exhibit some operational drawbacks and safety issues. For example, as has been noted hereinbefore, one known type of lounger chair is generally structured so as to be capable of undergoing two basic types of movements, that is, a first type of movement wherein the footrest is extended and elevated from an initial or default retracted position so as to support the legs of an occupant of the chair at a relaxed, elevated position, and a second type of movement wherein the entire chair is lifted or elevated, as well as lowered, so as to effectively assist the occupant of the chair to a standing position, or conversely, to a seated position within the chair. It has been noted and experienced, however, that conventional or prior art chairs of this type have exhibited instability problems, in connection with both side-by-side instability, as well as forward and backward instability, when the lift linkage assembly, for lifting and lowering the chair, is actuated. This is particularly troublesome for elderly people who comprise a significant percent of the overall number of users of such reclining lounger chairs. Examples of such lounger chairs may be appreciated from U.S. Pat. No. 8,403,409 which issued to Pollard et al. on Mar. 26, 2013, as well as U.S. Pat. No. 8,123,289 which issued to Qiu et al. on Feb. 28, 2012. More particularly, it has been determined that such instability tendencies are usually due to the relative disposition of the lift linkage assembly with respect to the reclining linkage assembly. Another factor impacting the presence of such instability tendencies of such conventional or prior art chairs is the fact that the centers of gravity of such chairs are located relatively forwardly within the overall structural assembly of the chair, and more particularly, forwardly of the lift linkage assembly when such lift linkage assembly is actuated, for example, by the linear actuator utilized for achieving the lift or elevational and lowering movements of the chair.

A need exists in the art for a new and improved powered chair. Another need exists in the art for a new and improved powered chair wherein the powered chair comprises a seat section, a footrest or ottoman section, and a back section. Still another need exists in the art for a new and improved powered chair wherein the powered chair comprises a seat section, a footrest or ottoman section, and a backrest section, wherein the footrest or ottoman is capable of being moved between retracted and extended positions, the seat section is capable of being moved between a default, horizontal position and a raised, inclined position, and the backrest section is capable of being moved between a default, upright position and a reclined position. Yet another need exists in the art for a new and improved powered chair wherein the powered chair comprises a seat section, a footrest or ottoman section, and a backrest section, wherein the footrest or ottoman is capable of being moved between retracted and extended positions, the seat section is capable of being moved between a default, horizontal position and a raised, inclined position, the backrest section is capable of being moved between a default, upright position and a reclined position, and wherein the entire chair is able to be moved between a default, lowered position and an elevated or lifted position so as to assist an occupant to stand or be seated within the chair.

Still yet another need exists in the art for a new and improved powered chair wherein the powered chair comprises a seat section, a footrest or ottoman section, and a backrest section, wherein the footrest or ottoman is capable of being moved between retracted and extended positions, the seat section is capable of being moved between a default, horizontal position and a raised, inclined position, the backrest section is capable of being moved between a default, upright position and a reclined position, wherein the entire chair is able to be moved between a default, lowered position, and an elevated or lifted position so as to assist an occupant to stand or be seated within the chair, and wherein the chair will exhibit enhanced stability, both in lateral, side-to-side directions as well as forward-backward directions, while the chair is being moved between its elevated or lifted and lowered positions. A further need exists in the art for a new and improved powered chair wherein the powered chair comprises a seat section, a footrest or ottoman section, and a backrest section, wherein the footrest or ottoman is capable of being moved between retracted and extended positions, the seat section is capable of being moved between a default, horizontal position and a raised, inclined position, the backrest section is capable of being moved between a default, upright position and a reclined position, wherein the entire chair is able to be moved between a default, lowered position and an elevated or lifted position so as to assist an occupant to stand or be seated within the chair, wherein the chair will exhibit enhanced stability, both in lateral, side-to-side directions as well as forward-backward directions, while the chair is being moved between its elevated, or lifted, and lowered positions, and wherein the footrest or ottoman section, and the seat section, of the chair are to be operated separately and independently from the lift or elevational movements of the chair.

OVERALL OBJECTIVES OF THE INVENTION

An overall objective of the present invention is to provide a new and improved powered chair. Another overall objective of the present invention is to provide a new and improved powered chair wherein the powered chair comprises a seat section, a footrest or ottoman section, and a back section. Still another overall objective of the present invention is to provide a new and improved powered chair wherein the powered chair comprises a seat section, a footrest or ottoman section, and a backrest section, and wherein the footrest or ottoman is capable of being moved between retracted and extended positions, the seat section is capable of being moved between a default, horizontal position and a raised, inclined position, and the backrest section is capable of being moved between a default, upright position and a reclined position. Yet another overall objective of the present invention is to provide a new and improved powered chair wherein the powered chair comprises a seat section, a footrest or ottoman section, and a backrest section, wherein the footrest or ottoman is capable of being moved from between retracted and extended positions, the seat section is capable of being moved between a default, horizontal position and a raised, inclined position, the backrest section is capable of being moved between a default, upright position and a reclined position, and wherein the entire chair is able to be moved between a default, lowered position and an elevated or lifted position so as to assist an occupant to stand or be seated within the chair.

Still yet another overall objective of the present invention is to provide a new and improved powered chair wherein the powered chair comprises a seat section, a footrest or ottoman section, and a backrest section, wherein the footrest or ottoman is capable of being moved from between retracted and extended positions, the seat section is capable of being moved between a default, horizontal position and a raised, inclined position, the backrest section is capable of being moved between a default, upright position and a reclined position, wherein the entire chair is able to be moved between a default, lowered position and an elevated or lifted position so as to assist an occupant to stand or be seated within the chair, and wherein the chair will exhibit enhanced stability, both laterally in side-to-side directions as well as forward-backward directions, while the chair is being moved between its elevated or lifted, and lowered positions. A further overall objective of the present invention is to provide a new and improved powered chair wherein the powered chair comprises a seat section, a footrest or ottoman section, and a backrest section, wherein the footrest or ottoman is capable of being moved from between retracted and extended positions, the seat section is capable of being moved between a default, horizontal position and a raised, inclined position, the backrest section is capable of being moved between a default, upright position and a reclined position, wherein the entire chair is able to be moved between a default, lowered position and an elevated or lifted position so as to assist an occupant to stand or be seated within the chair, wherein the chair will exhibit enhanced stability, both laterally in side-to-side directions as well as forward-backward directions, while the chair is being moved between its elevated or lifted, and lowered positions, and wherein the footrest or ottoman section, and the seat section, of the chair are to be operated separately and independently from the lift or elevational movements of the chair.

SUMMARY OF THE INVENTION

The foregoing and other objectives of the present invention are achieved by providing a new and improved powered chair which comprises a base framework, a pair of oppositely disposed lift base stanchions which are fixedly connected to oppositely disposed side frame members of the base framework, pairs of oppositely disposed upper and lower lift links which are pivotally connected at first ends thereof to the pair of oppositely disposed lift base stanchions, and a pair of oppositely disposed lift actuation links which are pivotally connected at first ends thereof to second ends of the pairs of oppositely disposed upper and lower lift links, while second opposite ends of the pair of oppositely disposed lift actuation links are pivotally connected to a pair of oppositely disposed seat rails. In this manner, the pair of oppositely disposed lift base stanchions, the pairs of oppositely disposed upper and lower lift links, and the pair of oppositely disposed lift actuation links define a four-sided linkage system wherein all of such linkage members are pivotally interconnected together so as to define a linkage system which exhibits enhanced strength and stability. Still further, a primary or first linear actuator has its motor end pivotally connected to a rear end frame member of the base framework, while the telescopic tube or rod of the primary or first linear actuator is pivotally connected to a transversely oriented front motor tube which has its opposite ends fixedly connected respectively to a pair of oppositely disposed front motor tube mounting brackets. The pair of oppositely disposed front motor tube mounting brackets are pivotally mounted upon a pair of oppositely disposed seat rail stop brackets which are fixedly mounted upon a pair of oppositely disposed seat rails. A pair of oppositely disposed main drive sequence links are pivotally mounted at first ends thereof upon the pair of oppositely disposed front motor tube mounting brackets, and a pair of oppositely disposed stop pins are respectively mounted upon the pair of seat rail stop brackets. In addition, the pair of oppositely disposed stop pins are adapted to be engaged by the pair of oppositely disposed main drive sequence links. Still further, second opposite ends of the main drive sequence links are pivotally connected to intermediate portions of a pair of oppositely disposed rear pivot links, first ends of the pair of oppositely disposed rear pivot links are pivotally mounted upon the pair of oppositely disposed seat rails, while second opposite ends of the pair of oppositely disposed rear pivot links are pivotally connected to first ends of a pair of oppositely disposed rear ottoman drive links. Second opposite ends of the pair of oppositely disposed rear ottoman drive links are, in turn, pivotally connected respectively to intermediate portions of a pair of oppositely disposed rear ottoman links which have first ends thereof pivotally connected to the pair of oppositely disposed seat rails while second opposite ends thereof are pivotally connected to first ends of a pair of oppositely disposed primary ottoman actuation links.

A pair of oppositely disposed front ottoman links have first ends thereof pivotally mounted upon the pair of oppositely disposed seat rails, intermediate portions thereof pivotally connected to intermediate portions of the pair of oppositely disposed primary ottoman actuation links, and second ends thereof pivotally connected to first ends of a pair of oppositely disposed secondary ottoman actuation links. Second opposite ends of the pairs of oppositely disposed primary and secondary ottoman actuation links are pivotally connected to opposite sides of a pair of oppositely disposed main ottoman actuation brackets, while a pair of oppositely disposed ottoman flipper brackets are pivotally mounted upon forward end portions of the main ottoman actuation brackets. To complete this assemblage, a pair of oppositely disposed ottoman flipper bracket drive links are pivotally connected between the pair of oppositely disposed secondary ottoman actuation links and the pair of oppositely disposed ottoman flipper brackets, upon which the ottoman is adapted to be fixedly mounted and attached. As will be more fully appreciated hereinafter, when the telescopic rod or tube of the first primary linear actuator is retracted, the pair of oppositely disposed front motor tube mounting brackets are rotated in the counterclockwise direction, when considered from an internal viewpoint looking at the right side of the chair, such that the pair of oppositely disposed main drive sequence links are moved forwardly so as to be disengaged from the pair of oppositely disposed stop pins whereby the various links are able to move the ottoman from its retracted position to its extended position. Conversely, when the telescopic rod or tube of the first primary linear actuator is extended, the pair of oppositely disposed front motor tube mounting brackets are rotated in the clockwise direction, when considered from the internal viewpoint looking at the right side of the chair, such that the pair of oppositely disposed main drive sequence links are moved rearwardly so as to be engaged with the pair of oppositely disposed stop pins whereby the various aforenoted links are effectively locked with respect to each other and the first primary linear actuator is able to cause the oppositely disposed pairs of upper and lower lift links, and the pair of oppositely disposed lift actuation links, to move upwardly, thereby effectively lifting the chair to its elevated position. Lastly, a second or secondary linear actuator is operatively connected to a pair of upper and lower, transversely oriented rear motor tubes, wherein opposite ends of the upper rear motor tube are fixedly connected to a pair of oppositely disposed backrest mounting brackets. Accordingly, when the telescopic rod or tube of the second or secondary linear actuator is fully extended, the pair of oppositely disposed backrest mounting brackets are disposed at their fully upright positions, whereas when the telescopic rod or tube of the second or secondary linear actuator is fully retracted, the pair of oppositely disposed backrest mounting brackets are disposed at their fully reclined positions. It is finally to be noted that the operations of the first and second linear actuators are entirely independent with respect to each other. In accordance with the foregoing, that is, as a result of the particular structural interrelationships defined by the ottoman extension/retraction system, as well as the chair lift system, and as will be more fully understood hereinafter, it is to be additionally appreciated that the overall structural system exhibits a desirable center of gravity and enhanced stability both laterally, that is, side to side, and longitudinally, that is, forwardly and backwardly.

BRIEF DESCRIPTIONS OF THE DRAWINGS

Figure 2:
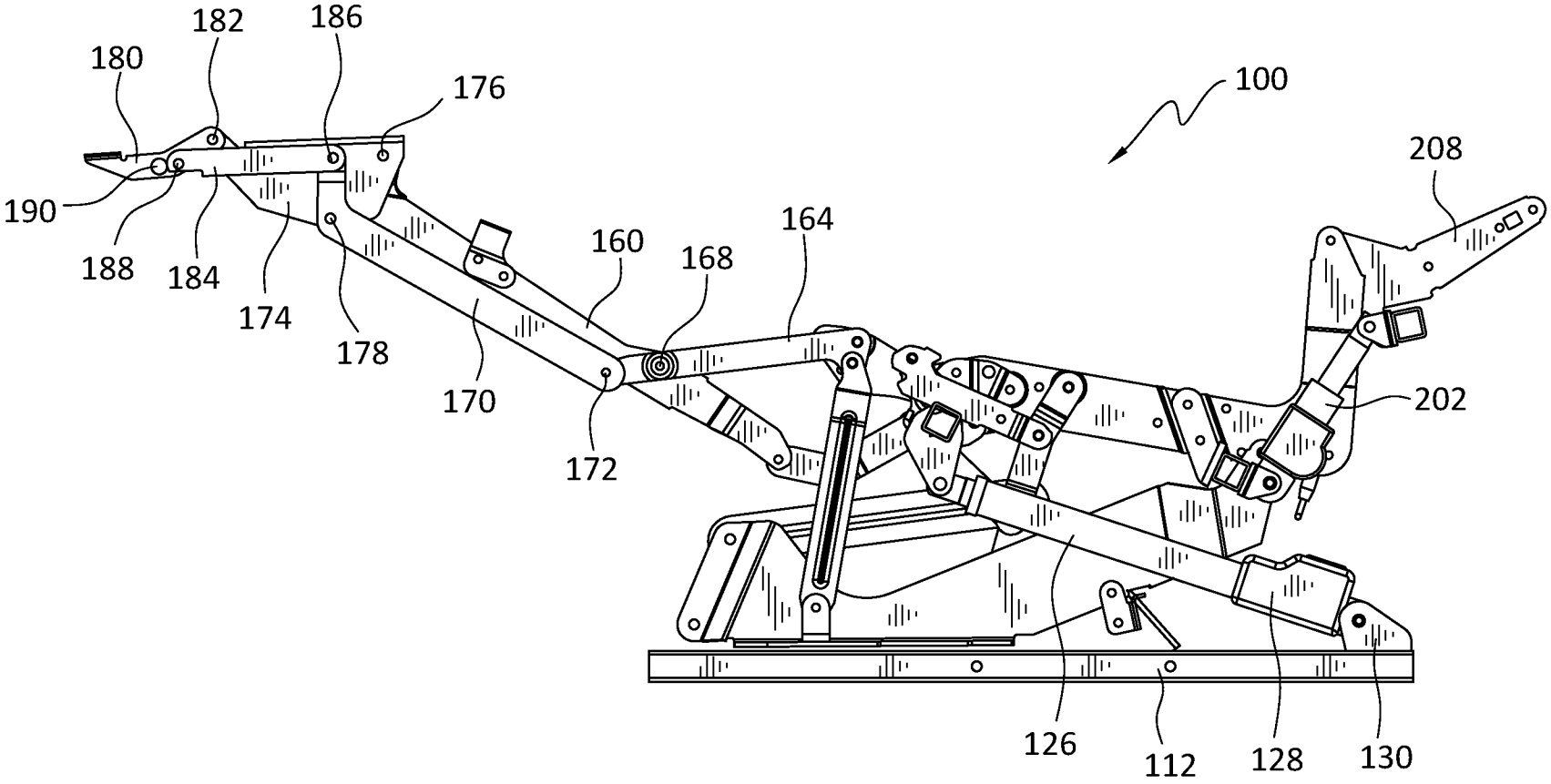
Figure 3:
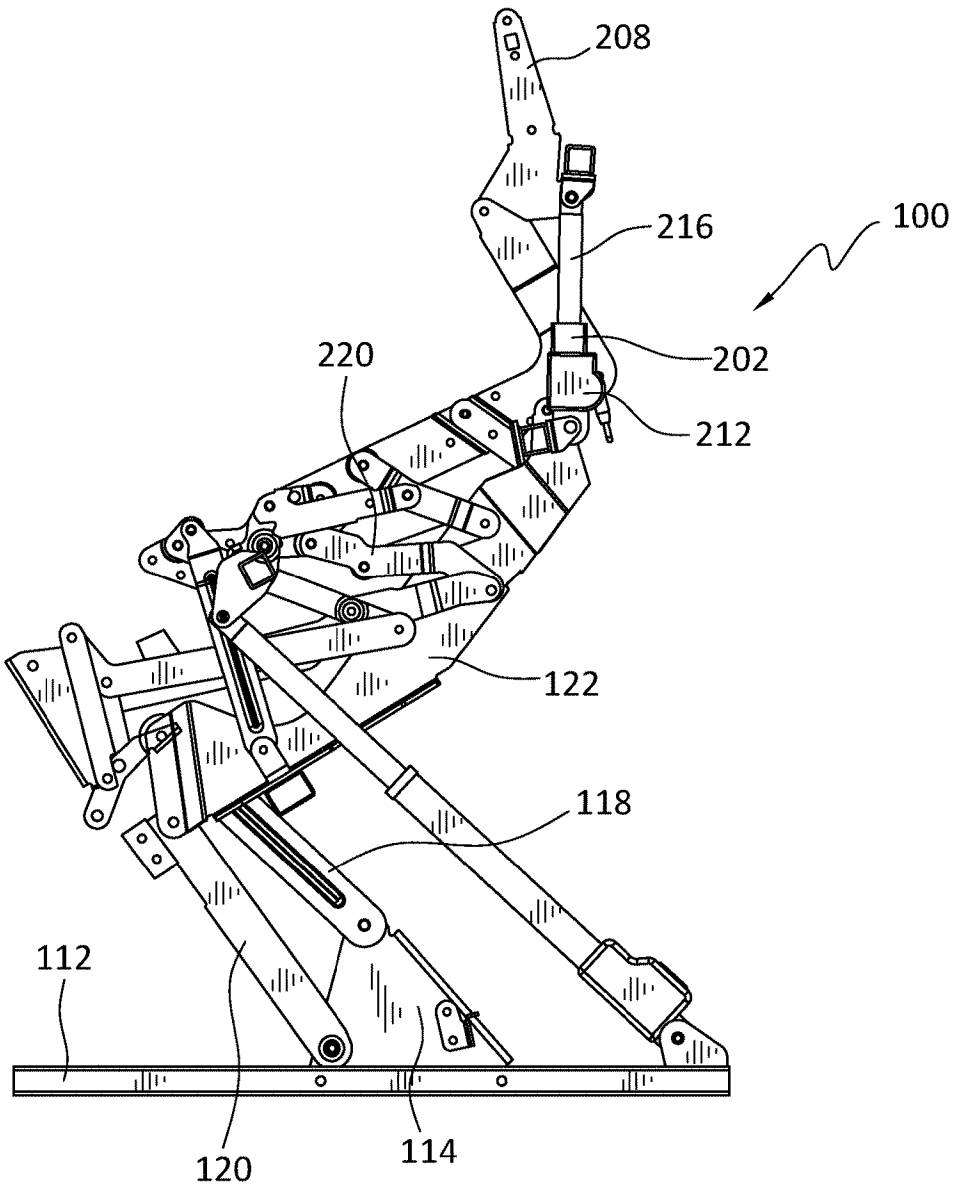
Figure 3A:
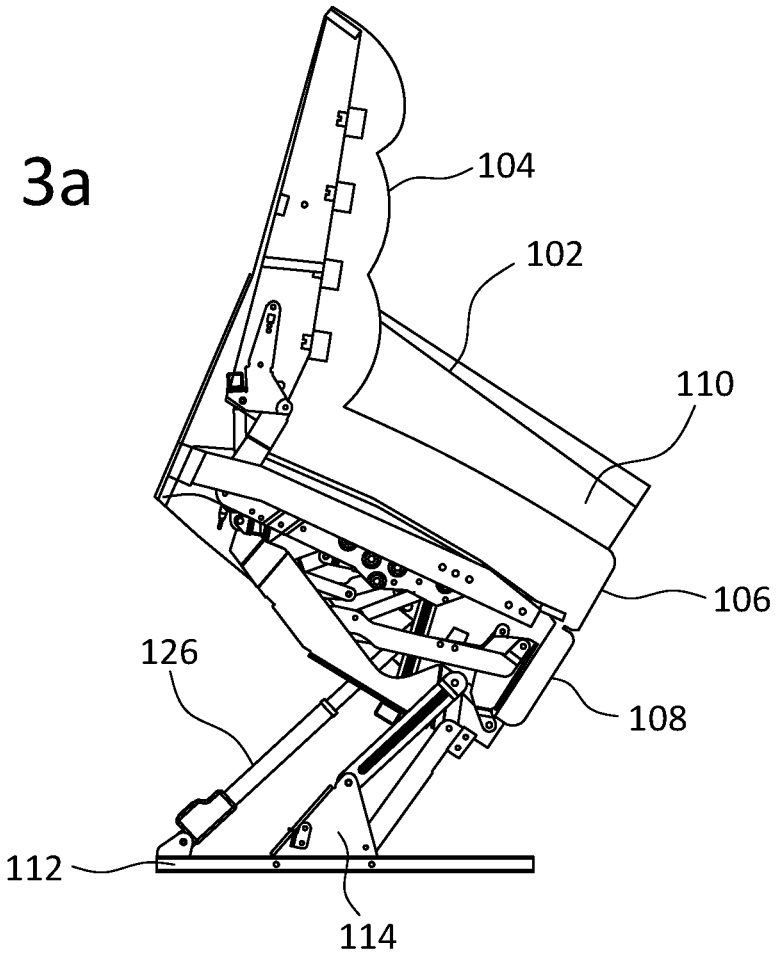
Figure 6A:
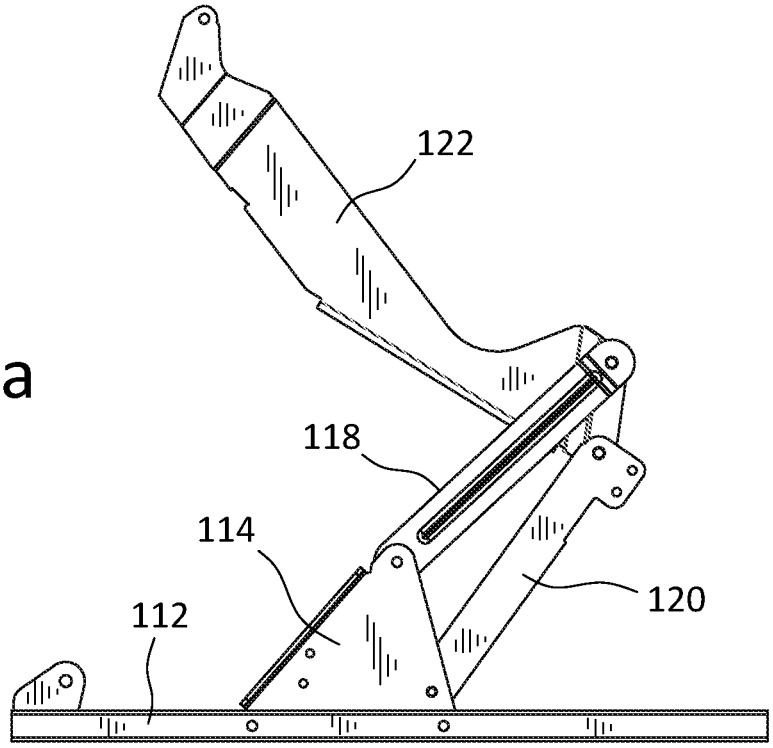
Figure 4A:
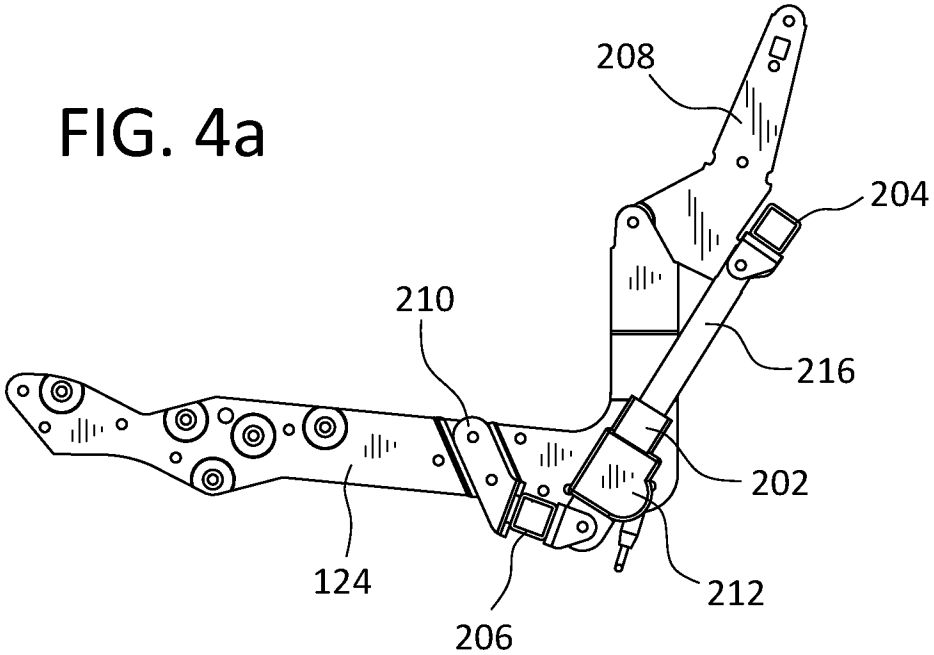
Figure 4B:
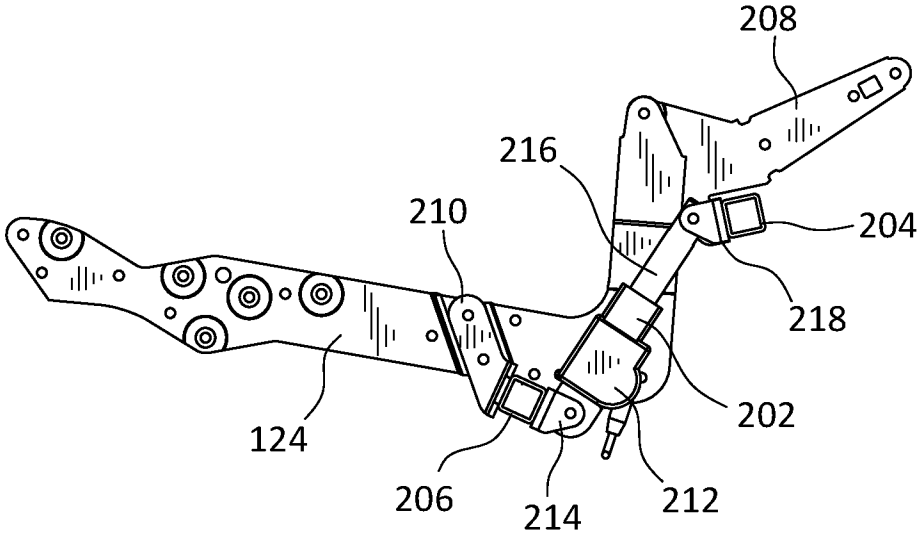
Figure 5A:
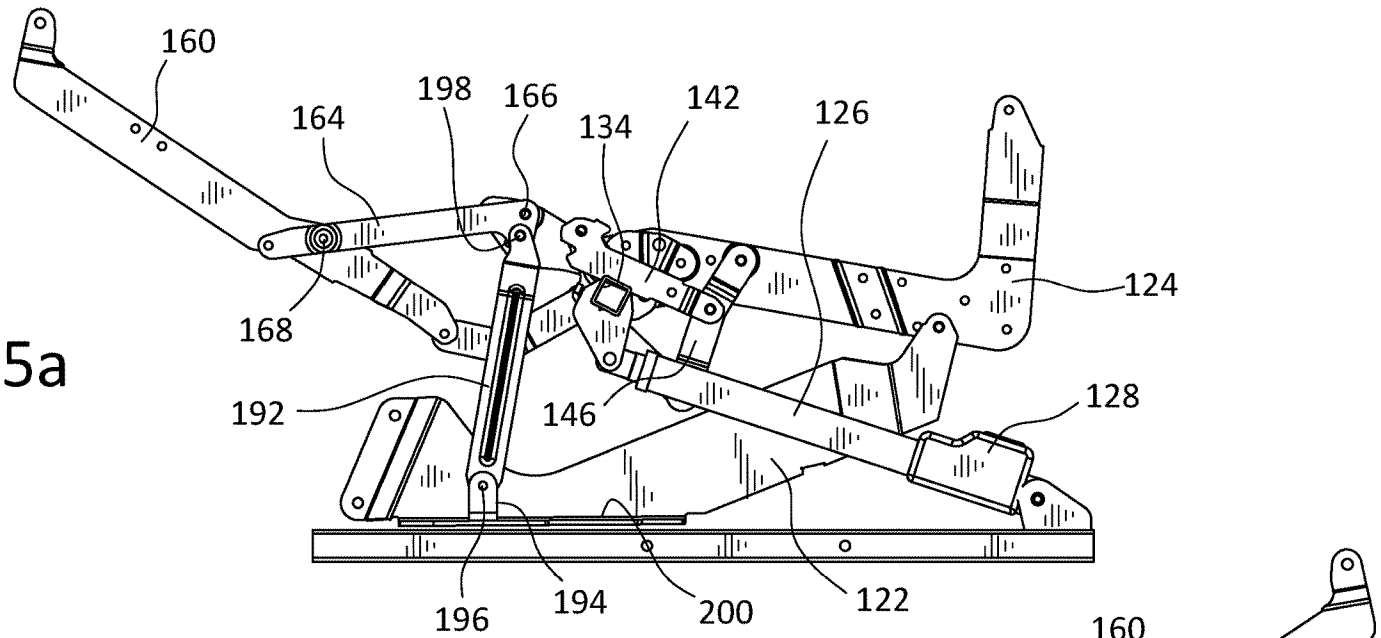
Figure 5B:
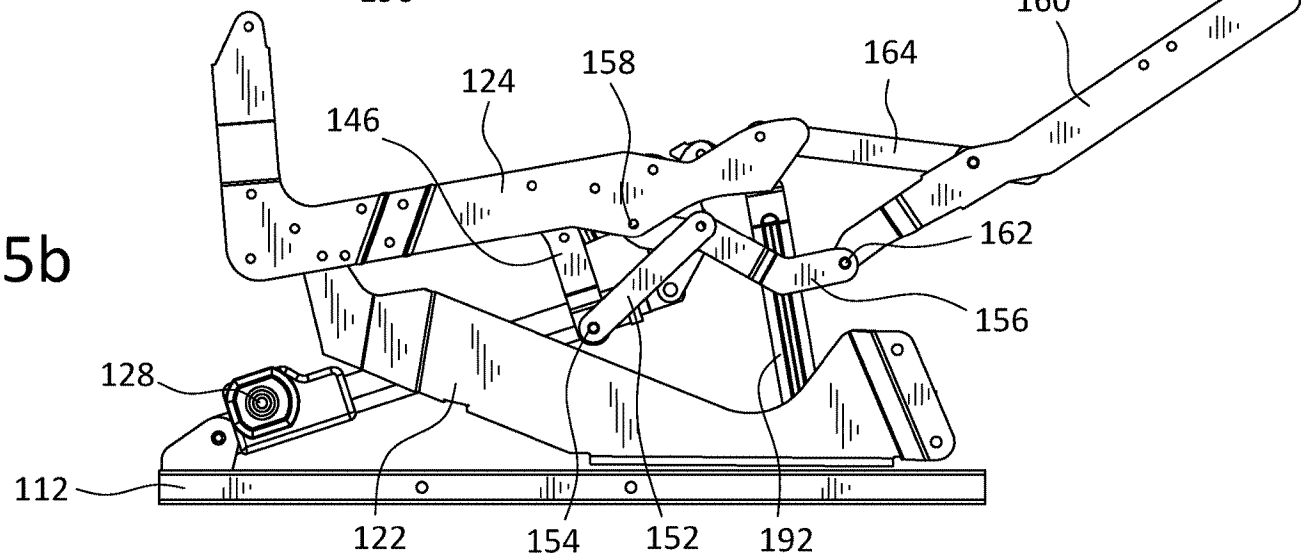
Figure 5C:
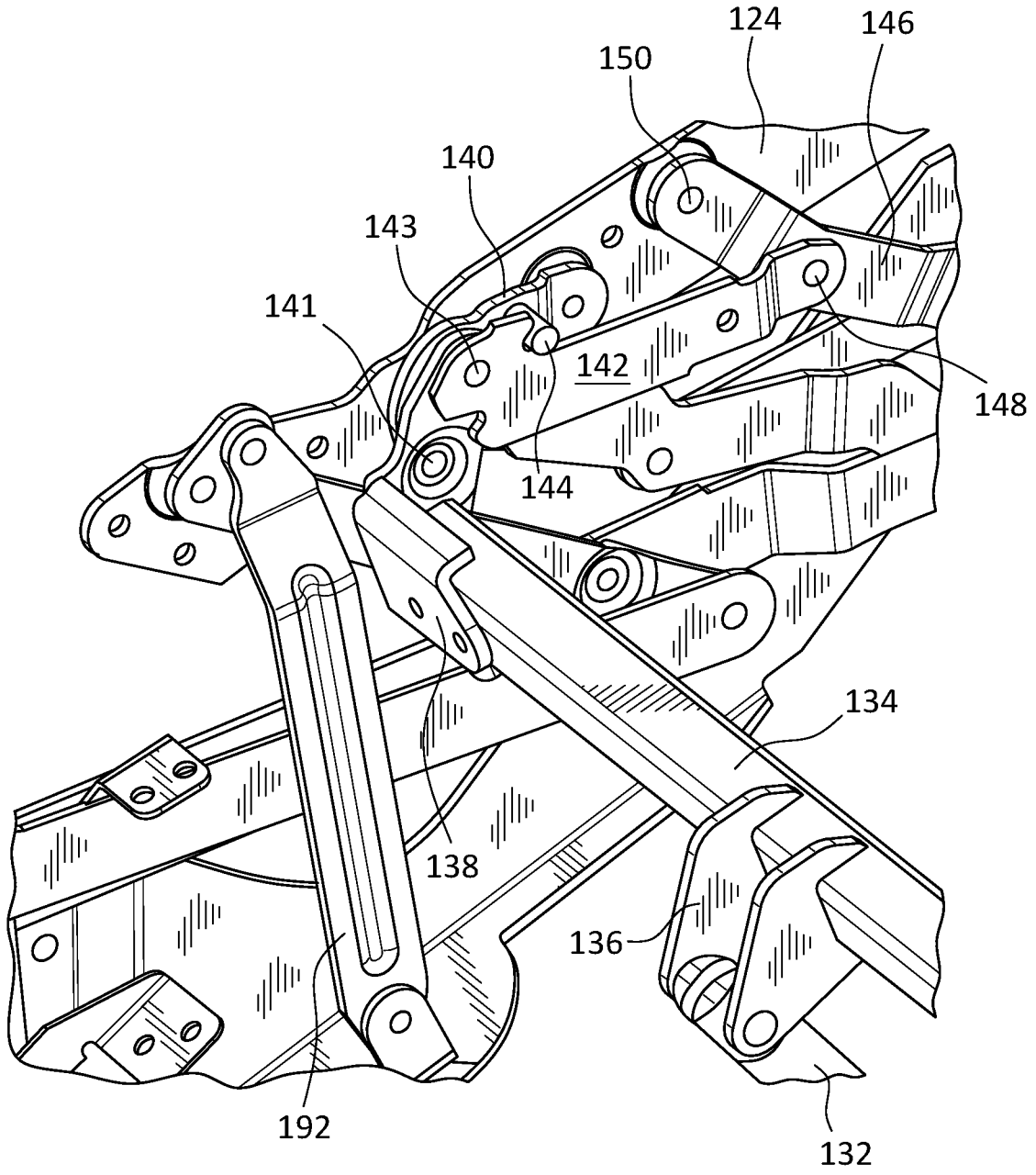
Figure 6:
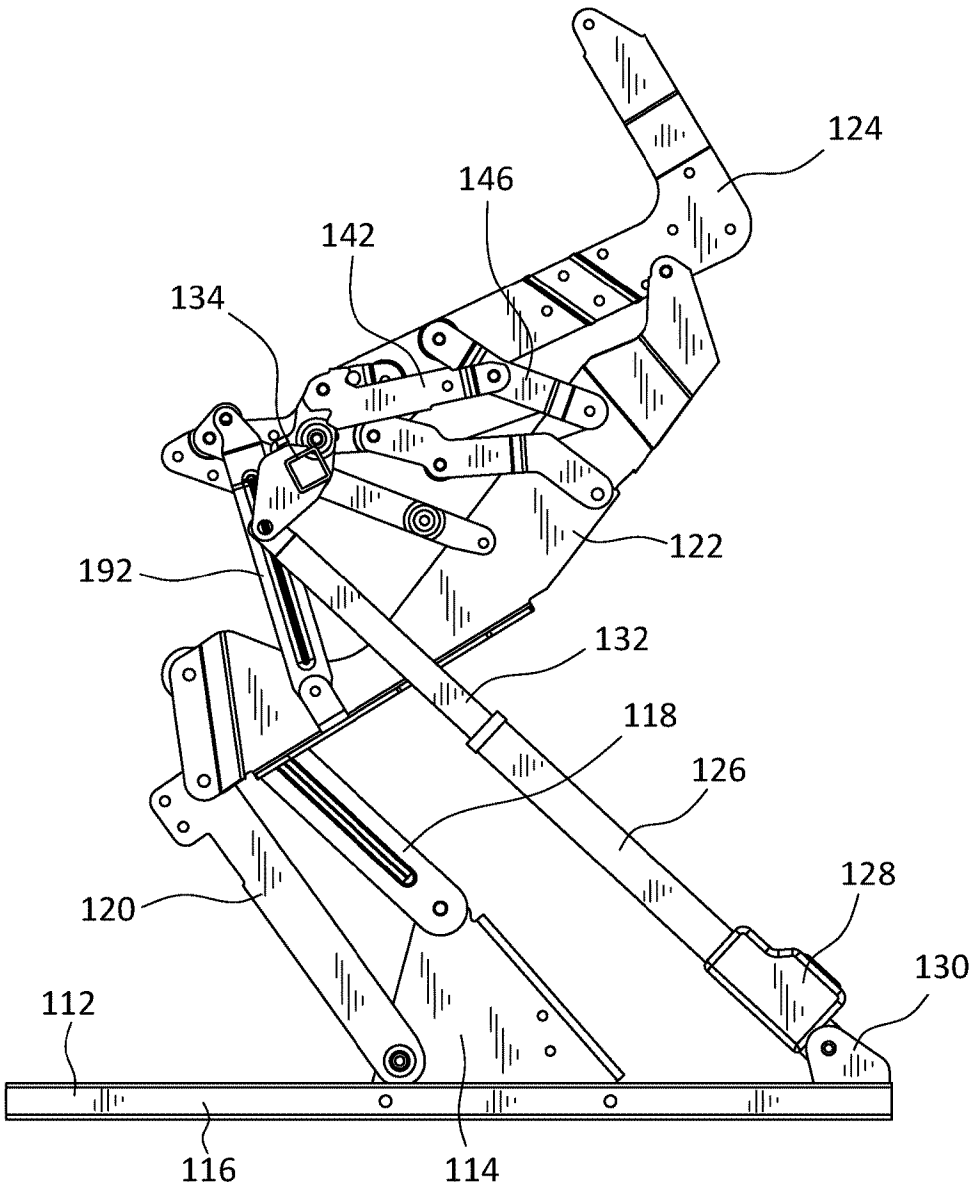
Figure 7A:
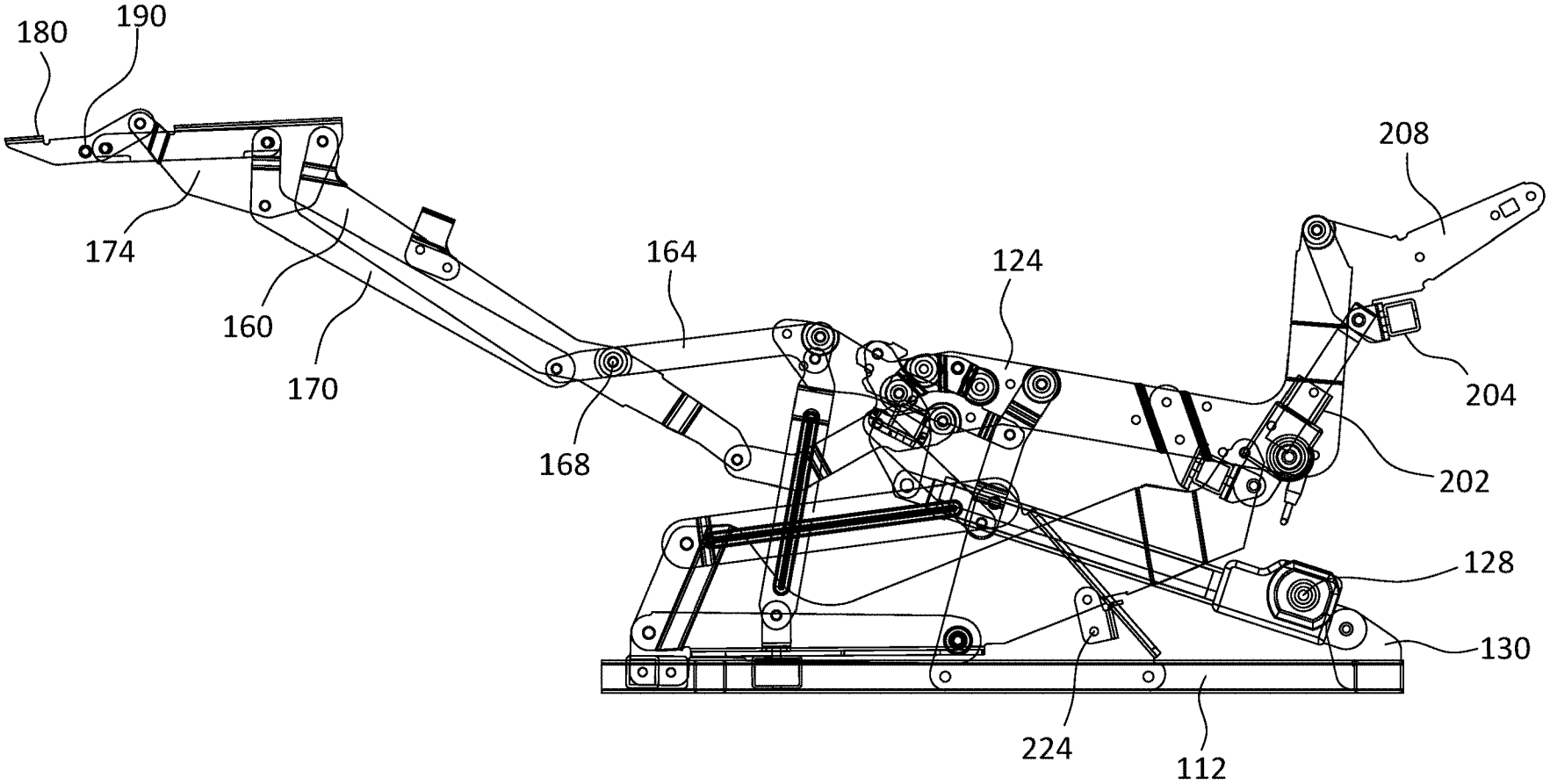
Figure 7B:
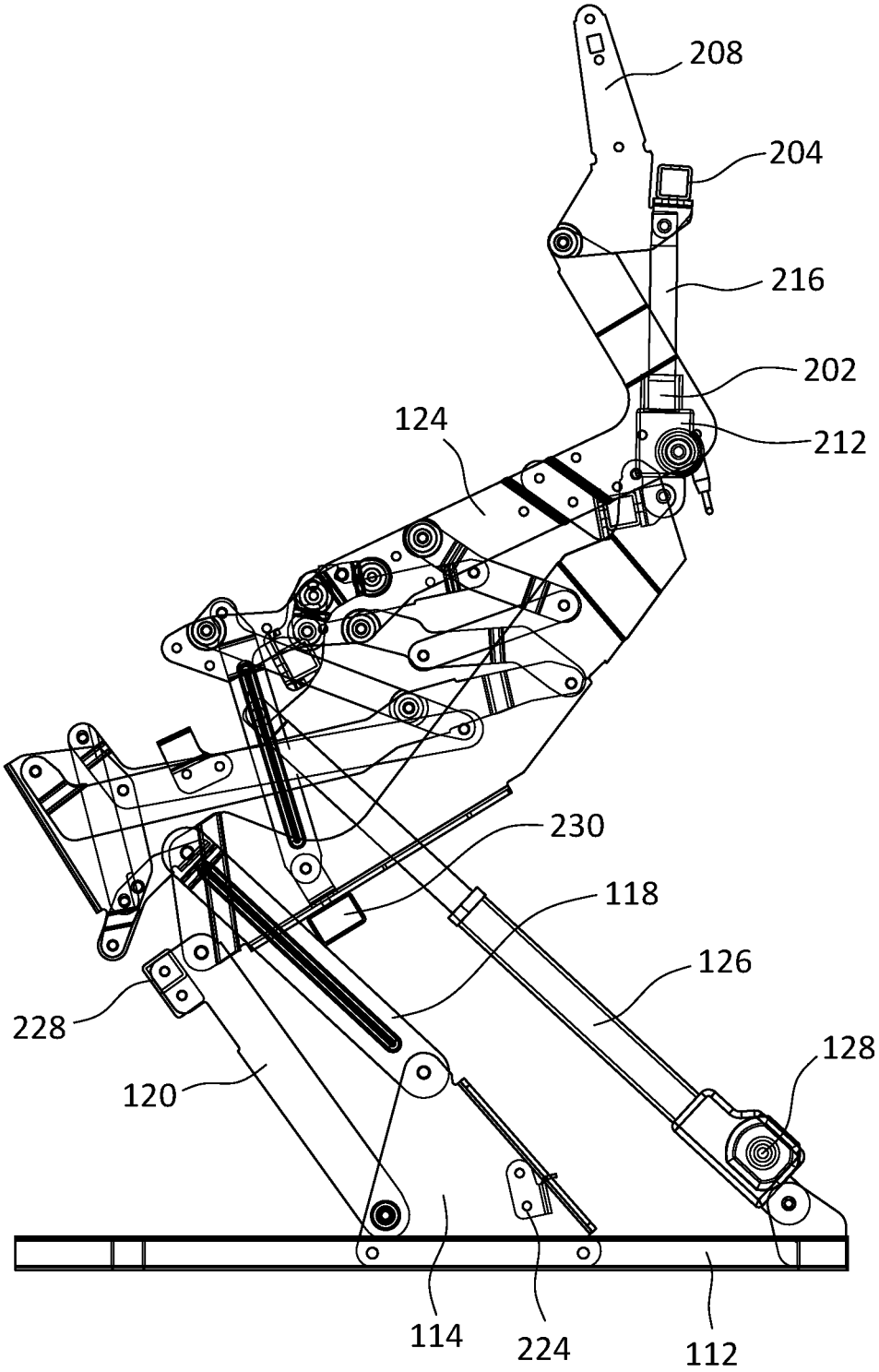
Figure 8:
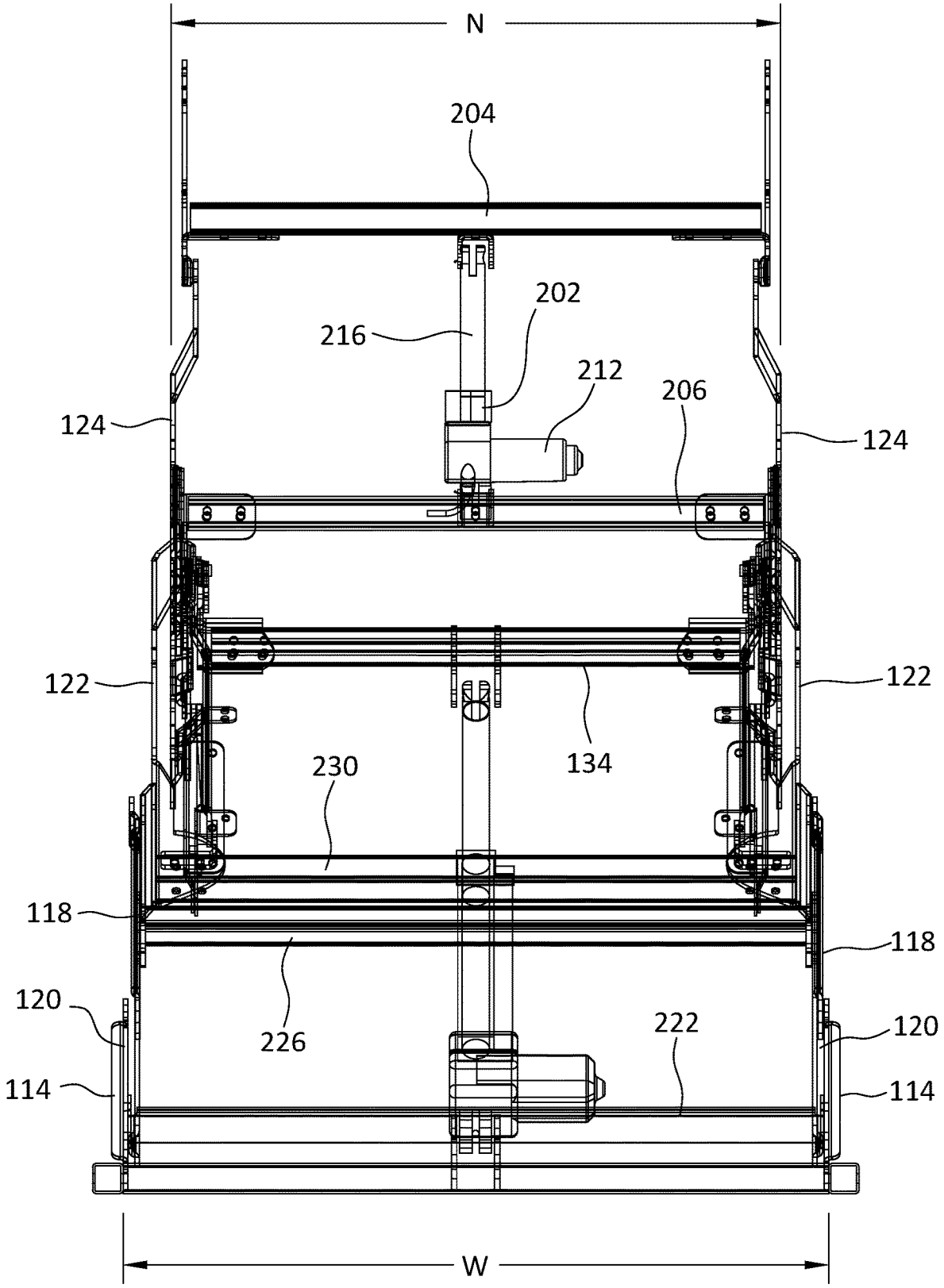

Various other features and attendant advantages of the present invention will be more fully appreciated from the following detailed description when considered in connection with the accompanying drawings in which like reference characters designate like or corresponding parts throughout the several views, and wherein:

FIG. 1 is a schematic side elevational view of the new and improved two-motor lift and recline system of the present invention wherein the telescopic rod or tube of the first primary linear actuator is disposed at an intermediate position, that is between its fully retracted and fully extended positions, such that the ottoman or footrest section of the powered chair is disposed at its retracted position while the chair is disposed at its lowered position, and wherein the second or secondary linear actuator is disposed at its fully extended position such that the backrest of the powered chair is disposed at its fully upright position;

FIG. 2 is a schematic side elevational view of the new and improved two-motor lift and recline system, and similar to that of FIG. 1, wherein, however, the telescopic rod or tube of the first primary linear actuator is disposed at its fully retracted position such that the ottoman or footrest section of the powered chair is disposed at its fully extended position, the chair is disposed at its lowered position, and the second or secondary linear actuator is disposed at its fully retracted position such that the backrest of the powered chair is disposed at its fully reclined position;

FIG. 3 is a schematic side elevational view of the new and improved two-motor lift and recline system, and similar to that of FIGS. 1 and 2, wherein, however, the telescopic rod or tube of the first primary linear actuator is disposed at its fully extended position such that the ottoman or footrest section of the powered chair is disposed at its fully retracted position, the chair has been moved to its fully elevated or lift position, and the second or secondary linear actuator is disposed at its fully extended position such that the backrest of the powered chair is disposed at its fully upright position;

FIG. 3*a* is a schematic cross-sectional view of a powered chair within which the new and improved two-motor lift and recline system, as has been illustrated within FIGS. 1-3, can be readily incorporated;

FIGS. 4*a* and 4*b* are schematic side elevational views showing the seat rail, the backrest, and the second or secondary linear actuator whereby it is illustrated how the second or secondary linear actuator moves the backrest between its fully upright position and its fully reclined position as a result of the telescopic rod or tube of the second or secondary linear actuator being respectively moved to its fully extended and its fully retracted positions;

FIG. 5*a* is another schematic side elevational view of the new and improved two-motor lift and recline system of the present invention, wherein FIG. 5*a* corresponds to FIG. 2 although some structural components have been eliminated from FIG. 5*a*, whereby together, the various structural components are clearly shown such that the various dispositions of the telescopic rod or tube of the first primary linear actuator are appreciated whereby the ottoman or footrest section of the powered chair is disposed at its fully extended position while the chair is disposed at its lowered position;

FIG. 5*b* is a schematic side elevational view of the new and improved two-motor lift and recline system of the present invention, and is identical to that of FIG. 5*a* except the viewpoint or perspective is from the opposite side of the system for further detail and clarity purposes;

FIG. 5*c* is an enlarged detailed schematic view, also supplemental to that of FIG. 5*a*, showing the various structural components for moving the ottoman linkages in order to achieve the full extension of the ottoman or footrest when the telescopic rod or tube of the first or primary linear actuator is disposed at its intermediate position;

FIG. 6 is another schematic side elevational view of the new and improved two-motor lift and recline system of the present invention, wherein FIG. 6 corresponds to FIG. 3 although some structural components have been eliminated from FIG. 6, whereby together, the various structural components are clearly shown such that the disposition of the telescopic rod or tube of the second or secondary linear actuator is appreciated whereby the new and improved powered chair has been moved to its lift or elevated position;

FIG. 6*a* is a schematic side elevational view, supplemental to that of FIG. 6, showing the details of how the various structural components are interconnected together so as to form or define the stable lift system for elevating the powered chair to its lift or elevated position when the telescopic rod or tube of the first or primary linear actuator has been moved to its fully extended position;

FIGS. 7*a* and 7*b* are schematic side-elevational views, similar to that of FIG. 2, schematically illustrating in greater detail the various structural components of the new and improved powered chair, having the new and improved two-motor lift and recline system of the present invention incorporated therein, relative to the base foundation and the lifting system for the chair whereby when the powered chair has its ottoman or footrest moved to its fully extended position and wherein the backrest has been moved to its fully reclined position, and wherein further, the chair has been moved from its lowered position to its lifted or elevated position; and FIG. 8 is a schematic front view of the new and improved two-motor lift and recline system of the present invention schematically illustrating the relative lateral disposition of the lift components of the new and improved two-motor lift and recline system of the present invention, relative to the recline components of the new and improved two-motor lift and recline system of the present invention, when the powered chair is moved to its lifted or elevated position, whereby the powered chair will exhibit enhanced stability in the lateral side-to-side directions.

DETAILED DESCRIPTION OF THE PREFERRED EMBODIMENT

Referring now to the drawings, and more particularly to FIGS. 1-3*a*, 6, and 6*a*, a new and improved two-motor lift and recline system for a powered chair is disclosed and is generally indicated by the reference character 100. More particularly, it is seen that the new and improved two-motor lift and recline system 100 for a powered chair may be readily incorporated within a chair 102, as is illustrated within FIG. 3*a*, wherein the chair 102 is seen to comprise a backrest 104, a seat 106, a footrest 108, and a pair of oppositely disposed side arms 110, only one of which is visible. With respect to the new and improved two-motor lift and recline system 100 incorporated within the chair 102, it is to be understood that many components of the system 100 comprise oppositely disposed pairs, disposed upon opposite sides of the chair 102, however, only one of such oppositely disposed pairs of components will be referred to and will be visible within the various drawing figures. Accordingly, it is seen that the new and improved two-motor lift and recline system 100 comprises a base framework 112, a pair of oppositely disposed lift base stanchions 114 which are fixedly connected to oppositely disposed side frame members 116 of the base framework 112, pairs of oppositely disposed upper and lower lift links 118,120 which are pivotally connected at first ends thereof to the pair of oppositely disposed lift base stanchions 114, and a pair of oppositely disposed lift support links 122 which are pivotally connected at first ends thereof to second ends of the pairs of oppositely disposed upper and lower lift links 118, 120, while second opposite ends of the pair of oppositely disposed lift support links 122 are pivotally connected to a pair of oppositely disposed seat rails 124, as can best be seen in FIGS. 6 and 6*a*, wherein the pair of oppositely disposed seat rails 124 are adapted to mount and support the chair seat 106 thereon. In this manner, it can be appreciated that the pair of oppositely disposed lift base stanchions 114, the pairs of oppositely disposed upper and lower lift links 118,120, and the pair of oppositely disposed lift support links 122 effectively define a four-sided linkage system wherein all of such linkage members are pivotally interconnected together such that the linkage system exhibits enhanced strength and stability.

Still further, and with reference being additionally made to FIGS. 5*c* and 6, a primary or first linear actuator 126 has its motor end 128 pivotally connected to a rear end frame member of the base framework 112 by a first clevis connector 130, while the telescopic tube or rod 132 of the primary or first linear actuator 126 is pivotally connected to a transversely oriented front motor tube 134, by a second clevis connector 136, wherein the transversely oriented front motor tube 134 has its opposite ends fixedly connected respectively to a pair of oppositely disposed front motor tube mounting brackets 138. The pair of oppositely disposed front motor tube mounting brackets 138 are pivotally mounted upon a pair of oppositely disposed seat rail stop brackets 140, as at 141, wherein the pair of oppositely disposed seat rail stop brackets 140 are, respectively, fixedly mounted upon the pair of oppositely disposed seat rails 124. A pair of oppositely disposed main drive sequence links 142 are pivotally mounted at first ends thereof upon the pair of oppositely disposed front motor tube mounting brackets 138, as at 143, and a pair of oppositely disposed stops, such as, for example, a pair of oppositely disposed stop pins 144, are respectively fixedly mounted upon the pair of oppositely disposed seat rail stop brackets 140. Alternatively, in lieu of the pair of oppositely disposed stop pins 144, projections could be provided upon the pair of oppositely disposed main drive sequence links 142 or upon the pair of oppositely disposed seat rail stop brackets 140. Still further, one or both pairs of oppositely disposed main drive sequence links 142 and oppositely disposed seat rail stop brackets 140 can be provided with interference projections.

In addition, the pair of oppositely disposed stop pins 144 are adapted to be engaged by notched portions defined within the pair of oppositely disposed main drive sequence links 142, as can best be appreciated from FIG. 5*c*. Still further, second opposite ends of the main drive sequence links 142 are pivotally connected to intermediate portions of a pair of oppositely disposed rear pivot links 146, as at 148, first ends of the pair of oppositely disposed rear pivot links 146 are pivotally mounted upon the pair of oppositely disposed seat rails 124 as at 150, while second opposite ends of the pair of oppositely disposed rear pivot links 146 are pivotally connected to first ends of a pair of oppositely disposed first rear ottoman drive links 152 as at 154, as can best be seen or appreciated from FIG. 5*b*. Second opposite ends of the pair of oppositely disposed rear ottoman drive links 152 are, in turn, pivotally connected respectively to intermediate portions of a pair of oppositely disposed second rear ottoman links 156 which have first ends thereof pivotally connected to the pair of oppositely disposed seat rails 124, as at 158, while second opposite ends thereof are pivotally connected to first ends of a pair of oppositely disposed primary ottoman actuation links 160 as at 162.

Continuing further, and as seen in FIG. 5*a*, a pair of oppositely disposed front ottoman links 164 have first ends thereof pivotally mounted upon the pair of oppositely disposed seat rails 124, as at 166, intermediate portions thereof pivotally connected to intermediate portions of the pair of oppositely disposed primary ottoman actuation links 160, as at 168, and second ends thereof pivotally connected to first ends of a pair of oppositely disposed secondary ottoman actuation links 170, as at 172 and as can best be seen in FIG. 2. Second opposite ends of the pairs of oppositely disposed primary and secondary ottoman actuation links 160,170 are pivotally connected to opposite sides of a pair of oppositely disposed main ottoman actuation and support brackets 174, as at 176,178, while a pair of oppositely disposed ottoman flipper and support brackets 180 are pivotally mounted upon forward end portions of the main ottoman actuation brackets 174 as at 182, wherein the brackets 174, 180 support an ottoman or footrest. To complete this assemblage, a pair of oppositely disposed ottoman flipper bracket drive links 184 are pivotally connected between the pair of oppositely disposed secondary ottoman actuation links 170 and the pair of oppositely disposed ottoman flipper brackets 180, upon which the ottoman is adapted to be fixedly mounted and attached, as at 186, 188. A second pair of oppositely disposed stop pins 190, similar to the first stop pins 144, are fixedly mounted upon the pair of oppositely disposed ottoman flipper brackets 180 so as to limit the movement of the ottoman flipper brackets 180 when they are moved to their retracted positions as illustrated within FIG. 1. This structural interaction will be discussed more fully when the operation of the system 100 is described.

Having therefore described substantially all of the structural components of the new and improved two-motor lift and recline system 100 for a powered chair 102, that are required to achieve the movement of the ottoman or footrest section of the chair from its stowed or retracted position to its deployed or extended position, the operation of the system, in order to achieve such movement of the ottoman or footrest section of the chair from its stowed or retracted position to its deployed or extended position, will now be described. Accordingly, with reference being made to FIGS. 1,2, and 5*a*-5*c*, when it is desired to move the ottoman or footrest from the stowed or retracted position, as illustrated within FIG. 1 and wherein the telescopic rod or tube 132 of the first primary linear actuator 126 is disposed at an intermediate position, to the deployed or extended position illustrated within FIG. 2, then the telescopic rod or tube 132 of the first primary linear actuator 126 will be fully retracted whereby the pair of oppositely disposed front motor tube mounting brackets 138 will be rotated in the counterclockwise direction, when considered from an internal viewpoint looking at the right side of the chair, and as seen in FIG. 5*c*, such that the pair of oppositely disposed main drive sequence links 142 are moved forwardly so as to be disengaged from the pair of oppositely disposed stop pins 144. Forward movement of the pair of oppositely disposed main drive sequence links 142 causes the clockwise rotation of the pair of oppositely disposed rear pivot links 146, again, as viewed within FIG. 5*c*, and the clockwise rotation of the pair of oppositely disposed rear pivot links 146 causes the forward movement of the pair of oppositely disposed first rear ottoman drive links 152. In turn, the forward movement of the pair of oppositely disposed first rear ottoman drive links 152 causes the forward movement of the pair of oppositely disposed second rear ottoman links 156 which, in turn, cause the forward extension of the pair of oppositely disposed primary ottoman actuation links 160.

The forward extension of the pair of oppositely disposed primary ottoman actuation links 160 causes the clockwise rotation of the pair of oppositely disposed front ottoman links 164, and such movement of the pair of oppositely disposed front ottoman links 164 causes the forward movement of the pair of oppositely disposed secondary ottoman actuation links 170 as can best be seen in FIG. 2. These forward movements of the pair of oppositely disposed primary ottoman actuation links 160, and the pair of oppositely disposed secondary ottoman actuation links 170, cause the pair of oppositely disposed ottoman flipper bracket drive links 184 to move rearwardly, or to the right as seen in FIG. 2, whereby the pair of oppositely disposed ottoman flipper brackets 180 are rotatably moved in the clockwise direction so as to attain their extended positions. It is to be lastly noted that, as can best be seen in FIG. 5*a*, a pair of oppositely disposed, substantially vertically oriented, front ottoman drive links 192 have their lower end portions pivotally connected to a pair of oppositely disposed ottoman drive anchor brackets 194, as at 196, while upper end portions of the pair of oppositely disposed, substantially vertically oriented, front ottoman drive links 192 are pivotally connected to the pair of oppositely disposed front ottoman links 164, as at 198.

Furthermore, it is seen that the pair of oppositely disposed ottoman drive anchor brackets 194 are fixedly secured to a pair of oppositely disposed mounting brackets 200 which are fixedly secured to undersurface portions of the pair of oppositely disposed lift actuation links 122. Accordingly, as the pair of oppositely disposed front ottoman links 164 are rotated in the clockwise direction, as viewed in FIG. 5*a*, the pair of oppositely disposed front ottoman links 164 will effectively exert forces upon the pair of oppositely disposed, substantially vertically oriented, front ottoman drive links 192 and thereby cause the front end portions of the pair of oppositely disposed seat rails 124 to be moved upwardly so as to, in turn, cause the front portion of the chair seat 106 to be elevated whereby the chair seat 106 will be inclined. It is of course to be appreciated that reverse movements of all of the structural components will be achieved when the telescopic rod or tube 132 of the first or primary linear actuator 124 is retracted back to its intermediate position, as illustrated within FIG. 1, wherein it is seen that the second pair of oppositely disposed stop pins 190 will engage the pair of oppositely disposed ottoman flipper bracket drive links 184 such that the pair of oppositely disposed ottoman flipper brackets 180 will not over-rotate, whereby the pair of oppositely disposed ottoman flipper brackets 180 will be properly positioned in readiness for a subsequent ottoman or footrest extension operation.

Alternatively or conversely, when it is desired to move the powered chair from its lowered position to the lift or elevated position as disclosed within FIGS. 3,3*a*, and 6, then the telescopic rod or tube 132 of the first primary linear actuator 126 will be fully extended, and the pair of oppositely disposed front motor tube mounting brackets 138 are rotated in the clockwise direction, when considered from the internal viewpoint looking at the right side of the chair and as viewed in FIGS. 5*a* and 5*c*, such that the pair of oppositely disposed main drive sequence links 142 are moved rearwardly so as to be engaged with the pair of oppositely disposed stop pins 144, as can best be seen in FIG. 5*c*, whereby the various aforenoted links are effectively locked together with respect to each other. Accordingly, the first primary linear actuator 126 is able to cause the chair 102 to be moved to its lifted, raised, or elevated position as a result of the extension of the telescopic rod or tube 132 of the first primary linear actuator 126 effectively acting through the pair of oppositely disposed seat rails 124. It is of course to be appreciated that the pair of oppositely disposed seat rails 124 are stably supported by the pairs of oppositely disposed lift support links 122, the pair of oppositely disposed upper and lower lift links 118, 120, and the pair of oppositely disposed lift base stanchions 114.

With reference now being made to FIGS. 1-3, 4*a*, and 4*b*, it is additionally seen that a second or secondary linear actuator 202 is operatively connected to a pair of upper and lower, transversely oriented, rear motor tubes 204,206 in order to move the backrest 104 between a fully upright position and a fully reclined position as respectively disclosed within FIGS. 4*a* and 4*b*. The backrest 104 of the powered chair is adapted to be mounted upon a pair of oppositely disposed backrest mounting brackets 208, and it is to be appreciated that the upper, transversely oriented rear motor tube 204 has its opposite ends fixedly connected to the pair of oppositely disposed backrest mounting brackets 208. In a similar manner, a pair of oppositely disposed lower rear motor tube mounting brackets 210 are respectively fixedly mounted upon the pair of oppositely disposed seat rails 124, and opposite ends of the lower rear motor tube 206 are fixedly mounted upon the pair of oppositely disposed lower rear motor tube mounting brackets 210. The second or secondary linear actuator 202 has its motor end 212 pivotally connected to the lower rear motor tube 206 by a lower clevis connector 214 which is fixedly mounted upon the lower rear motor tube 206, while the second or secondary linear actuator 202 has its telescopic rod or tube end 216 pivotally connected to the upper rear motor tube 204 by an upper clevis connector 218 which is fixedly mounted upon the upper rear motor tube 204. Accordingly, it can be appreciated that when the telescopic rod or tube 216 of the second or secondary linear actuator 202 is fully extended, as can best be seen in FIG. 4*a*, the pair of oppositely disposed backrest mounting brackets 208 will be disposed at their fully upright positions, whereas when the telescopic rod or tube 216 of the second or secondary linear actuator 202 is fully retracted, as can best be appreciated from FIG. 4*b*, the pair of oppositely disposed backrest mounting brackets 208 will be disposed at their fully reclined positions. It is lastly to be noted that the operations of the first and second linear actuators 126,202 are entirely independent with respect to each other whereby the extension and retraction of the chair ottoman or footrest 108 between its fully extended and retracted positions, as well as the elevation and lowering of the powered chair between its lifted or elevated state or position, and its lowered state or position, are entirely independent of the movement of the chair backrest 104 between its fully upright and fully reclined positions, and vice versa.

In accordance with the foregoing, that is, as a result of the particular structural interrelationships defined by the ottoman extension and retraction system, as well as the chair lift system, it is to be additionally appreciated that the overall structural system exhibits a desirable center of gravity and enhanced stability both laterally, that is, side-to-side, and longitudinally, that is, forwardly and backwardly. More particularly, with reference being made to FIG. 3, it is to be appreciated that the new and improved two-motor lift and recline system 100 for a powered chair is structured such that the center of gravity (CG) 220 of the same is effectively disposed at the center of the chair, when considered from a side-to-side or lateral perspective, as well as in line with the pair of oppositely disposed lift base stanchions 114 when considered from a front-to-back or longitudinal perspective. Accordingly, it can be readily appreciated that when the primary or first linear actuator 126 moves the chair 102 from its lowered position, as illustrated within FIG. 1, to its elevated or lift position, as illustrated within FIGS. 3 and 6, the new and improved two-motor lift and recline system 100 will in fact impart to the chair 102 an enhanced level of stability, both laterally, that is, side-to-side, and longitudinally, that is, forwardly and backwardly.

In conjunction with such enhanced stability, reference is lastly made to FIGS. 7*a*, 7*b*, and 8 wherein it is seen that supplemental stabilization components are incorporated within the new and improved two-motor lift and recline system 100 so as to in fact achieve the aforenoted enhanced side-to-side stability. In addition, it will become clear that as a result of the unique disposition of the linkage components utilized to achieve the lift or elevation of the chair, with respect to, or relative to, the disposition of the linkage components utilized to achieve the footrest or ottoman extension movements, enhanced side-to-side stability is further achieved and ensured. More particularly, and as will be more fully appreciated hereinafter, the disposition of the linkage components utilized to achieve the lift or elevation of the chair is seen to effectively define a wider footprint or stance, as compared to that of the linkage components utilized to achieve the footrest or ottoman extension movements, in view of the fact that the linkage components utilized to achieve the lift or elevation of the chair are disposed laterally outwardly of, or externally to, the linkage components utilized to achieve the footrest or ottoman extension movements. As can therefore be appreciated with reference being made to FIGS. 7*a*, 7*b*, and 8, a center stabilizer rail 222 has its oppositely disposed end portions fixedly connected to a pair of laterally spaced center stabilizer rail mounting brackets 224 which are fixedly mounted upon the pair of oppositely disposed lift base stanchions 114. In a similar manner, a front stabilizer 226 has its oppositely disposed end portions fixedly connected to a pair of laterally spaced front stabilizer mounting brackets 228 which are fixedly mounted upon the pair of oppositely disposed lower lift links 120. In addition, a front cross-tube 230 has its oppositely disposed end portions fixedly mounted upon undersurface portions of the pair of oppositely disposed lift support links 122. This multiplicity of structural stabilizer components and cross-tubes serve to integrally connect the various pairs of oppositely disposed chair components together so as to further enhance the structural stability of the powered chair.

Lastly, as can best be appreciated from FIG. 8, which is a schematic front view of the new and improved two-motor lift and recline system of the present invention schematically illustrating the relative lateral disposition of the lift components of the new and improved two-motor lift and recline system of the present invention, relative to the recline components of the new and improved two-motor lift and recline system of the present invention, when the powered chair has been moved to its lifted or elevated position, whereby it can be seen that the pair of oppositely disposed lift base stanchions 114, along with the upper and lower lift links 118,120, are spaced apart a predetermined distance W. This is to be compared with the lateral spacing N which is defined between the pair of oppositely disposed seat rails 124 which are operatively connected to the pair of oppositely disposed lift support links 122, by the multiplicity of intervening and interconnecting linkage members. Accordingly, it is readily appreciated that the disposition of the linkage components utilized to achieve the lift or elevation of the chair is seen to effectively define a wider footprint or stance, as compared to that of the linkage components utilized to achieve the footrest or ottoman extension movements, in view of the fact that the linkage components utilized to achieve the lift or elevation of the chair are disposed laterally outwardly of, or externally to, the linkage components utilized to achieve the footrest or ottoman extension movements. In this manner, when the powered chair is moved to its lifted or elevated position, the powered chair will exhibit enhanced stability in the lateral side-to-side directions.

Obviously, many variations and modifications of the present invention are possible in light of the above teachings. It is therefore to be understood that within the scope of the appended claims, the present invention may be practiced otherwise than as specifically described herein.

What is claimed is:

1. A two-motor lift and recline system for a powered chair, comprising:

a base;

at least one footrest/ottoman support bracket for mounting and supporting a footrest or ottoman thereon;

at least one seat rail for mounting and supporting a seat thereon;

at least one backrest support bracket for mounting and supporting a backrest thereon;

a first linear actuator having a motor end pivotally mounted upon said base and a telescopic tube/rod end operatively connected to said at least one seat rail, wherein said first linear actuator is operatively connected to said at least one footrest/ottoman support bracket for moving said at least one footrest/ottoman support bracket between extended and retracted positions such that when said telescopic tube/rod end of said first linear actuator is fully retracted, said first linear actuator will cause said at least one footrest/ottoman support bracket to be moved to said extended position, whereas when said telescopic tube/rod end is fully extended, said first linear actuator will cause said chair to be moved to a lifted/elevated position; and a second linear actuator mounted upon said at least one seat rail and operatively connected to said at least one backrest support bracket for moving said at least one backrest support bracket between fully upright and fully reclined positions.

2. The two-motor lift and recline system for a powered chair as set forth in claim 1, wherein:

said first linear actuator is operatively connected to said at least one footrest/ottoman support bracket by a plurality of linkage members; and a stop defined upon one of said at least one seat rail and at least one linkage member of said plurality of linkage members which are adapted to be engaged with and disengaged from each other such that when said telescopic tube/rod of said first linear actuator is retracted, said at least one linkage member of said plurality of linkage members and said stop will be disengaged from each other whereby said first linear actuator can move said at least one footrest or ottoman support bracket to said extended position, whereas when said telescopic tube/rod of said first linear actuator is extended, said at least one linkage member of said plurality of linkage members and said stop will be engaged with each other whereby said first linear actuator can move said chair to said lifted/elevated position.

3. The two-motor lift and recline system for a powered chair as set forth in claim 2, wherein:

said plurality of linkage members are operatively connected to said at least one seat rail such that when said telescopic tube/rod of said first linear actuator is retracted so as to move said at least one footrest/ottoman support bracket to said extended position, a front portion of said at least one seat rail will be elevated whereby a front portion of said seat of said powered chair will be elevated whereby said seat will be inclined.

4. The two-motor lift and recline system for a powered chair as set forth in claim 1, wherein:

said first linear actuator is mounted upon said base by a four-sided linkage system comprising at least one lift base stanchion, upper and lower lift links pivotally connected at first ends thereof to said at least one lift base stanchion, and at least one lift support link pivotally connected at a first end thereof to second opposite ends of said upper and lower lift links, while a second opposite end of said at least one lift support link is pivotally connected to said at least one seat rail such that said four-sided linkage system stably supports said at least one seat rail.

5. The two-motor lift and recline system for a powered chair as set forth in claim 4, wherein:

the center of gravity (CG) of said powered chair is disposed at the center of the chair, when considered from a side-to-side or lateral perspective, as well as in line with said at least one lift base stanchion when considered from a front-to-back or longitudinal perspective such that when said first linear actuator moves said powered chair from its lowered position to its elevated/lift position, said powered chair will exhibit enhanced stability, both laterally in a side-to-side mode, and longitudinally in a forwardly and backwardly mode.

6. The two-motor lift and recline system for a powered chair as set forth in claim 1, wherein:

said second linear actuator comprises a motor end pivotally mounted upon said at least one seat rail, and a telescopic tube/rod end pivotally connected to said at least one backrest support bracket such that when said telescopic tube/rod of said second linear actuator is extended, said at least one backrest support bracket will be moved to said fully upright position, whereas when said telescopic tube/rod of said second linear actuator is retracted, said at least one backrest support bracket will be moved to said fully reclined position.

7. A two-motor lift and recline system for a powered chair, comprising:

a base;

at least one footrest/ottoman support bracket for mounting and supporting a footrest or ottoman thereon;

at least one seat rail for mounting and supporting a seat thereon;

at least one backrest support bracket for mounting and supporting a backrest thereon; and a linear actuator mounted upon said base and operatively connected to said at least one seat rail for moving said at least one footrest or ottoman support bracket between extended and retracted positions, and operatively connected to said seat rail for also moving said powered chair between a lowered position and a lifted/elevated position.

8. The two-motor lift and recline system for a powered chair as set forth in claim 7, wherein:

said linear actuator comprises a motor end pivotally mounted upon said base, and a telescopic tube/rod end operatively connected to said at least one seat rail, wherein when said telescopic tube/rod end of said linear actuator is fully retracted, said linear actuator will cause said at least one footrest/ottoman support bracket to be moved to said extended position, whereas when said telescopic tube/rod end of said linear actuator is fully extended, said linear actuator will cause said chair to be moved to said lifted/elevated position.

9. The two-motor lift and recline system for a powered chair as set forth in claim 8, wherein:

said linear actuator is operatively connected to said at least one footrest/ottoman support bracket by a plurality of linkage members; and a stop defined upon one of said at least one seat rail and at least one linkage member of said plurality of linkage members which are adapted to be engaged with and disengaged from each other such that when said telescopic tube/rod of said first linear actuator is retracted, said at least one linkage member of said plurality of linkage members and said stop will be disengaged from each other whereby said first linear actuator can move said at least one footrest or ottoman support bracket to said extended position, whereas when said telescopic tube/rod of said first linear actuator is extended, said at least one linkage member of said plurality of linkage members and said stop will be engaged with each other whereby said first linear actuator can move said chair to said lifted/elevated position.

10. The two-motor lift and recline system for a powered chair as set forth in claim 9, wherein:

said plurality of linkage members are operatively connected to said at least one seat rail such that when said telescopic tube/rod of said first linear actuator is retracted so as to move said at least one footrest/ottoman support bracket to said extended position, a front portion of said at least one seat rail will be elevated whereby a front portion of said seat of said powered chair will be elevated whereby said seat will be inclined.

11. The two-motor lift and recline system for a powered chair as set forth in claim 7, wherein:

said linear actuator is mounted upon said base by a four-sided linkage system comprising at least one lift base stanchion, upper and lower lift links pivotally connected at first ends thereof to said at least one lift base stanchion, and at least one lift support link pivotally connected at a first end thereof to second opposite ends of said upper and lower lift links, while a second opposite end of said at least one lift support link is pivotally connected to said at least one seat rail such that said four-sided linkage system stably supports said at least one seat rail.

12. The two-motor lift and recline system for a powered chair as set forth in claim 11, wherein:

the center of gravity (CG) of said powered chair is disposed at the center of the chair, when considered from a side-to-side or lateral perspective, as well as in line with said at least one lift base stanchion when considered from a front-to-back or longitudinal perspective, such that when said first linear actuator moves said powered chair from said lowered position to said elevated/lift position, said powered chair will exhibit enhanced stability, both laterally in a side-to-side mode, and longitudinally in a forwardly and backwardly mode.

13. The two-motor lift and recline system for a powered chair as set forth in claim 7, further comprising:

a second linear actuator mounted upon said at least one seat rail and operatively connected to said at least one backrest support bracket for moving said at least one backrest support bracket between fully upright and fully reclined positions.

14. The two-motor lift and recline system for a powered chair as set forth in claim 13, wherein:

said second linear actuator comprises a motor end pivotally mounted upon said at least one seat rail, and a telescopic tube/rod end pivotally connected to said at least one backrest support bracket such that when said telescopic tube/rod of said second linear actuator is extended, said at least one backrest support bracket will be moved to said fully upright position, whereas when said telescopic tube/rod of said second linear actuator is retracted, said at least one backrest support bracket will be moved to said fully reclined position.

15. A two-motor lift and recline system for a powered chair, comprising:

a base;

at least one footrest/ottoman support bracket for mounting and supporting a footrest or ottoman thereon;

at least one seat rail for mounting and supporting a seat thereon;

at least one backrest support bracket for mounting and supporting a backrest thereon;

a linear actuator mounted upon said base and operatively connected to said at least one footrest/ottoman support bracket, for moving said at least one footrest/ottoman support bracket between extended and retracted positions, and operatively connected to said seat rail for moving said powered chair between a lowered position and a lifted/elevated position; and a first set of oppositely disposed linkage members operatively connecting said linear actuator to said at least one footrest/ottoman support bracket for moving said at least one footrest/ottoman support bracket between extended and retracted positions, and a second set of oppositely disposed linkage members operatively connecting said linear actuator to said seat rail for moving said powered chair between a lowered position and a lifted/elevated position, wherein said second set of oppositely disposed linkage members are separated a second predetermined distance apart from each other which is greater than a first predetermined distance defined between said first set of oppositely disposed linkage members such that when said linear actuator moves said powered chair to said lifted/elevated position, said second predetermined distance defined between said second set of oppositely disposed linkage members will define a footprint or stance between said second set of oppositely disposed linkage members which provides enhanced side-to-side directional stability.

16. The two-motor lift and recline system for a powered chair as set forth in claim 15, wherein:

said linear actuator comprises a motor end pivotally mounted upon said base, and a telescopic tube/rod end operatively connected to said at least one seat rail, wherein when said telescopic tube/rod end of said linear actuator is fully retracted, said linear actuator will cause said at least one footrest/ottoman support bracket to be moved to said extended position, whereas when said telescopic tube/rod end of said linear actuator is fully extended, said linear actuator will cause said chair to be moved to said lifted/elevated position.

17. The two-motor lift and recline system for a powered chair as set forth in claim 15, wherein:

said linear actuator is operatively connected to said at least one footrest/ottoman support bracket by a plurality of linkage members; and a stop defined upon one of said at least one seat rail and at least one linkage member of said plurality of linkage members which are adapted to be engaged with and disengaged from each other such that when said telescopic tube/rod of said first linear actuator is retracted, said at least one linkage member of said plurality of linkage members and said stop will be disengaged from each other whereby said first linear actuator can move said at least one footrest or ottoman support bracket to said extended position, whereas when said telescopic tube/rod of said first linear actuator is extended, said at least one linkage member of said plurality of linkage members and said stop will be engaged with each other whereby said first linear actuator can move said chair to said lifted/elevated position.

18. The two-motor lift and recline system for a powered chair as set forth in claim 17, wherein:

said plurality of linkage members are operatively connected to said at least one seat rail such that when said telescopic tube/rod of said linear actuator is retracted so as to move said at least one footrest/ottoman support bracket to said extended position, a front portion of said at least one seat rail will be elevated whereby a front portion of said seat of said powered chair will be elevated whereby said seat will be inclined.

19. The two-motor lift and recline system for a powered chair as set forth in claim 15, wherein:

said linear actuator is mounted upon said base by a four-sided linkage system comprising at least one lift base stanchion, upper and lower lift links pivotally connected at first ends thereof to said at least one lift base stanchion, and at least one lift support link pivotally connected at a first end thereof to second opposite ends of said upper and lower lift links, while a second opposite end of said at least one lift support link is pivotally connected to said at least one seat rail such that said four-sided linkage system stably supports said at least one seat rail.

* * * * *